US006868613B2

(12) United States Patent
Sumner

(10) Patent No.: US 6,868,613 B2
(45) Date of Patent: Mar. 22, 2005

(54) TRIM INSTALLATION TOOL AND METHOD

(76) Inventor: Melvin W. Sumner, 234 S. Elm St., Ottawa, KS (US) 66067

( * ) Notice: Subject to any disclaimer, the term of this patent is extended or adjusted under 35 U.S.C. 154(b) by 0 days.

(21) Appl. No.: 10/419,505

(22) Filed: Apr. 21, 2003

(65) Prior Publication Data

US 2003/0204961 A1 Nov. 6, 2003

Related U.S. Application Data

(63) Continuation-in-part of application No. 09/735,386, filed on Dec. 12, 2000, now abandoned.

(51) Int. Cl.[7] ..... E06B 3/00
(52) U.S. Cl. ..... 33/194
(58) Field of Search ..... 33/370, 373, 374, 33/375, 333, 384, 385, 382, 451, 194; 269/43, 228, 795, 905, 143, 201, 249

(56) References Cited

U.S. PATENT DOCUMENTS

| | | | | | |
|---|---|---|---|---|---|
| 493,566 | A | | 3/1893 | Steedman | |
| 761,430 | A | | 5/1904 | Vreeland | |
| 880,252 | A | | 2/1908 | Tennent | |
| 1,017,811 | A | | 2/1912 | Scelza | |
| 1,336,157 | A | | 4/1920 | Read | |
| 1,340,995 | A | | 5/1920 | Werner | |
| 1,946,961 | A | * | 2/1934 | Blade | 33/194 |
| 2,497,570 | A | * | 2/1950 | Abshire | 33/669 |
| 2,502,166 | A | * | 3/1950 | McKay | 33/194 |
| 2,636,282 | A | | 4/1953 | Kronquist | |
| 2,771,688 | A | | 11/1956 | Baker | |
| 2,855,695 | A | * | 10/1958 | Buck | 33/370 |
| 2,973,584 | A | | 3/1961 | Snapp | |
| 3,102,345 | A | | 9/1963 | Holland | |
| 3,168,305 | A | * | 2/1965 | Lee | 269/37 |
| 3,183,581 | A | | 5/1965 | Lister | |
| 3,199,206 | A | | 8/1965 | Snapp | |
| 3,751,810 | A | | 8/1973 | Valva | |
| 3,799,533 | A | | 3/1974 | Malott | |
| 3,851,868 | A | * | 12/1974 | Lagasse | 269/8 |
| 3,859,002 | A | | 1/1975 | Sauey | |
| 4,251,962 | A | | 2/1981 | Langenhorst | |
| 4,435,908 | A | | 3/1984 | Semler, Jr. | |
| 4,478,016 | A | | 10/1984 | Allen | |
| 4,635,414 | A | | 1/1987 | Allen | |
| 4,733,475 | A | | 3/1988 | Youmans | |
| 4,829,727 | A | | 5/1989 | Kuzara, Jr. | |
| 4,989,336 | A | | 2/1991 | Waltrip, Jr. et al. | |
| 5,088,682 | A | * | 2/1992 | Gibbs | 248/542 |
| 5,123,172 | A | | 6/1992 | Thrun | |
| 5,167,073 | A | | 12/1992 | Stein | |
| 5,377,462 | A | | 1/1995 | Beals et al. | |
| 5,402,579 | A | | 4/1995 | Smith | |
| 5,673,903 | A | | 10/1997 | Lewis | |
| 5,711,644 | A | | 1/1998 | Regnath et al. | |
| 2002/0134463 | A1 | * | 9/2002 | Torstensen | 144/144.51 |
| 2003/0005589 | A1 | | 1/2003 | Hale et al. | |
| 2004/0000061 | A1 | * | 1/2004 | Tuthill | 33/194 |

FOREIGN PATENT DOCUMENTS

| | | |
|---|---|---|
| GB | 11603 | 8/1884 |

* cited by examiner

*Primary Examiner*—Diego Gutierrez
*Assistant Examiner*—Mirellys Jagan
(74) *Attorney, Agent, or Firm*—Mark Brown

(57) ABSTRACT

A trim installation tool includes a base with first and second ends, inner and outer faces, and opposite side edges. First and second clamp assemblies are mounted on the base in proximity to its first and second ends respectively. The clamp assemblies have engaged and disengaged positions for respectively clamping and releasing a wall edge adjacent to the wall opening. An elongated level with an orientation-display device is mounted on the base inner face and extends generally between the ends thereof. The orientation-display device indicates a level or plumb orientation of a trim piece clamped in position by the tool for attachment to the frame members surrounding the wall opening. In an alternative embodiment or aspect of the invention, a trim installation system and method are provided, which include a level and a trim piece spacer.

1 Claim, 9 Drawing Sheets

TRIM INSTALLATION TOOL AND METHOD

CROSS-REFERENCE TO THE RELATED APPLICATIONS

This application is a continuation-in-part of U.S. patent application Ser. No. 09/735,386, filed Dec. 12, 2000, now abandoned.

BACKGROUND OF THE INVENTION

1. Field of the Invention

The present invention relates generally to clamping and leveling tools and procedures, and in particular to a cased opening trim installation tool and method.

2. Description of the Related Art

In construction, wall openings are commonly formed for various purposes, e.g. to accommodate doors and windows. Sometimes wall openings are formed and left open to provide relatively free access between adjacent rooms in a structure. A relatively large number of interior partitions in residential and commercial construction are assembled in this manner. Many interior residential partitions have overall thicknesses of about 4½ inches. One of the advantages of having relatively uniform-thickness partitions is that I sizes of millwork for trimming same can be relatively uniform and standardized. Such standardization can be desirable because of the efficiencies involved in utilizing common trim sizes which are sized for the most popular wall thicknesses.

Such openings are often edged with trim pieces to conceal the framing members which surround and frame the opening, and also to provide a finished, aesthetically pleasing appearance which can be relatively uniform throughout the structure. A typical opening trim system might include, for example, a pair of jamb trim pieces each mounted on a respective side of the opening on a respective framing member framing same, a header or transom trim piece mounted on the underside of a header assembly constructed of structural framing members, and casing trim consisting of both jamb and header casing trim pieces for mounting on the wall faces on both sides around the opening. Additional trim pieces can be added, e.g., door stops for door openings, etc.

The widths of wall openings encountered in constructions vary considerably, but headers are normally placed at about 6'-8" to 7' above the floor, whereby standard doors with heights in the range of about 6'-8" to 7' can be accommodated. Since the trim around such an opening is typically a conspicuously visible part of the finished building interior, relatively precise installation can be highly desirable. However, rough-in or frame carpentry can be relatively inaccurate, with the framing lumber bordering the opening being somewhat out-of-plumb, out-of-square, etc.

To accommodate for such inaccuracies, the opening trim pieces are often carefully positioned within the wall openings to provide same with square and plumb configurations. The fine positioning of the jamb and header trim pieces can be accomplished with wedge-shaped shims inserted between the trim pieces and the opening framing members. The relative spacing between the trim pieces and the opening framing members can be adjusted by varying the number of shims and their thicknesses. However, such procedures tend to be relatively time consuming and awkward, particularly for unassisted workers. Difficulties can be encountered in installing such trim pieces in a square, plumb manner, particularly with respect to temporarily positioning the shims and casing trim pieces for nailing. During nailing, the shims and the trim pieces can shift, causing misalignment. Such problems can be compounded when a door is hingedly mounted on one of the jamb trim pieces.

Therefore, conventional methods of installing cased opening trim pieces tended to produce results which were sometimes lacking in uniformity and neatness of appearance.

Certain types of construction, particularly commercial and institutional facilities, involve the use of steel door frames and steel studs in lieu of wood, which is commonly used in residential construction. Steel door frames are often prefabricated for placement in the wall openings prior to installing the wall panels. It is desirable for such door frame assemblies to be properly positioned when fastened to the wall structures in which they are mounted.

A previous solution to the problem of positioning and holding trim in door and window openings during installation utilized a tool with a level adapted for mounting in an opening with set screws. With the installation tool in place, the jam and header trim could be properly positioned and nailed in place. However, the set screws used for attaching the tool tended to slow installation and removal. Moreover, the previous tool did not accommodate standard, commercially-available levels and was not readily adjustable for various wall thicknesses.

The present invention addresses the aforementioned problems with previous equipment and techniques for trimming wall openings.

BRIEF DESCRIPTION OF THE INVENTION

In the practice of the present invention, a trim installation tool is provided which includes a base having first and second ends, inner and outer faces, and opposite side edges. First and second clamp assemblies are mounted on the base first and second ends respectively. Each clamp assembly includes first and second clamp brackets connected by a bridge. Each first clamp bracket mounts a toggle clamp with an over-center plunger mechanism. The clamp assemblies have engaged positions adapted for engaging a wall and disengaged positions disengaged therefrom. An elongated level with orientation-display assemblies is mounted on the base inner face and extends generally between the ends thereof. Optional spacers are provided for spacing the base to provide clearance for a door trim piece.

OBJECTS AND ADVANTAGES OF THE INVENTION

The principle objects and advantages of the present invention include: providing a wall opening trim installation tool; providing such a tool which is adapted for installing trim in a relatively square and plumb configuration; providing such a tool which is adapted for installing trim around various types of openings including door openings, clear openings and window openings in walls; providing such a tool which facilitates installing trim by a single worker; providing such a tool which can be adjusted for various wall thicknesses; providing such a tool which provides relatively accurate placement for trim systems in wall openings of various sizes; providing such a tool which is adapted for firmly clamping casing trim in place prior to being permanently nailed; providing such a tool which accommodates nailing of casing trim permanently in place with nail guns and the like; providing such a tool which utilizes commercially-available levels; and providing such a tool which is economical to manufacture, efficient in operation, capable of a long operating life, designed for fabrication from common materials and components, and which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

The drawings constitute a part of this specification and include exemplary embodiments of the present invention and illustrate various objects and features thereof.

DETAILED DESCRIPTION OF THE INVENTION

I. Introduction

Figure 1:
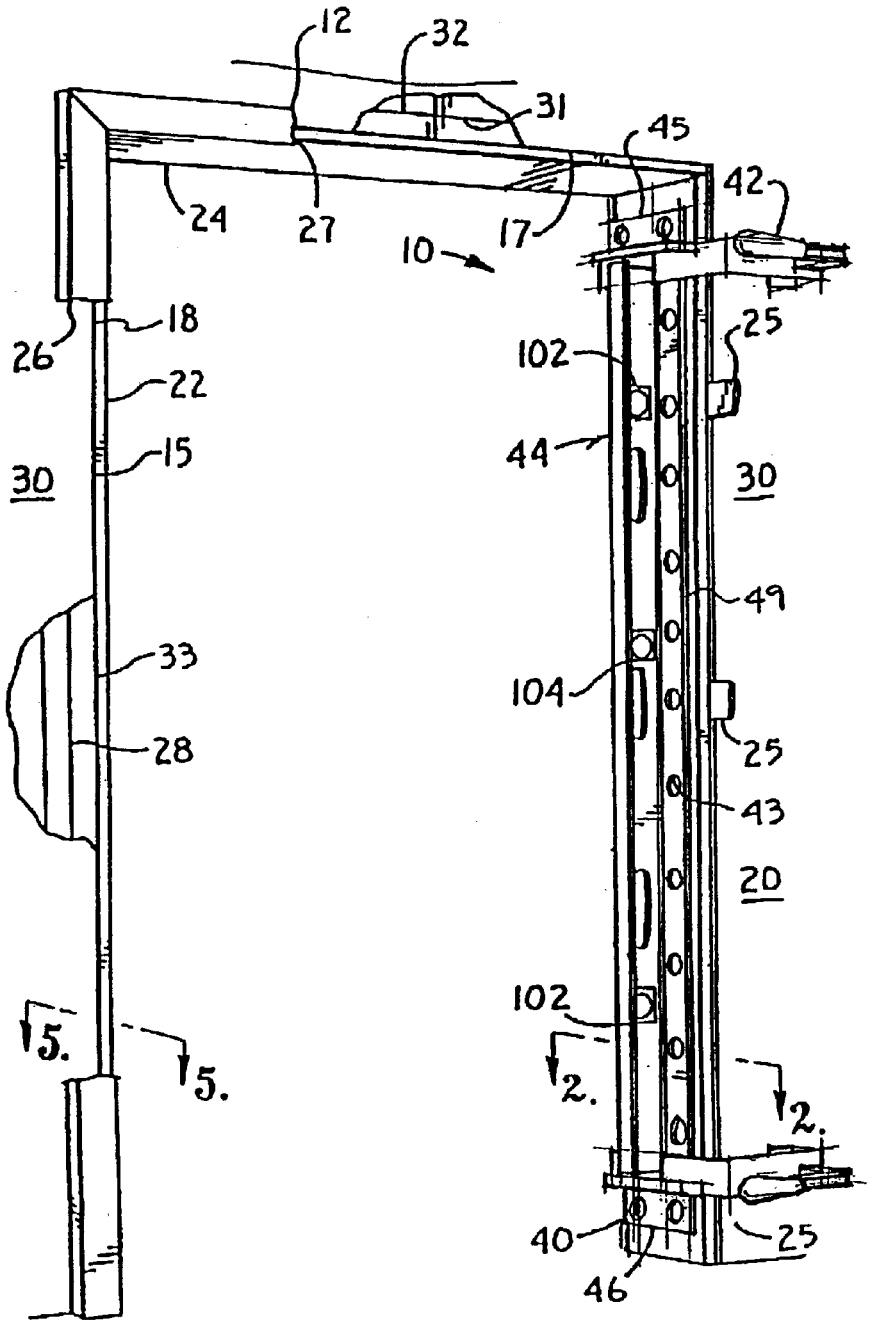
FIG. 1 is a perspective view of a wall with an opening and a trim installation tool embodying the present invention clamped to the wall at a side edge of the opening.
Figure 2:
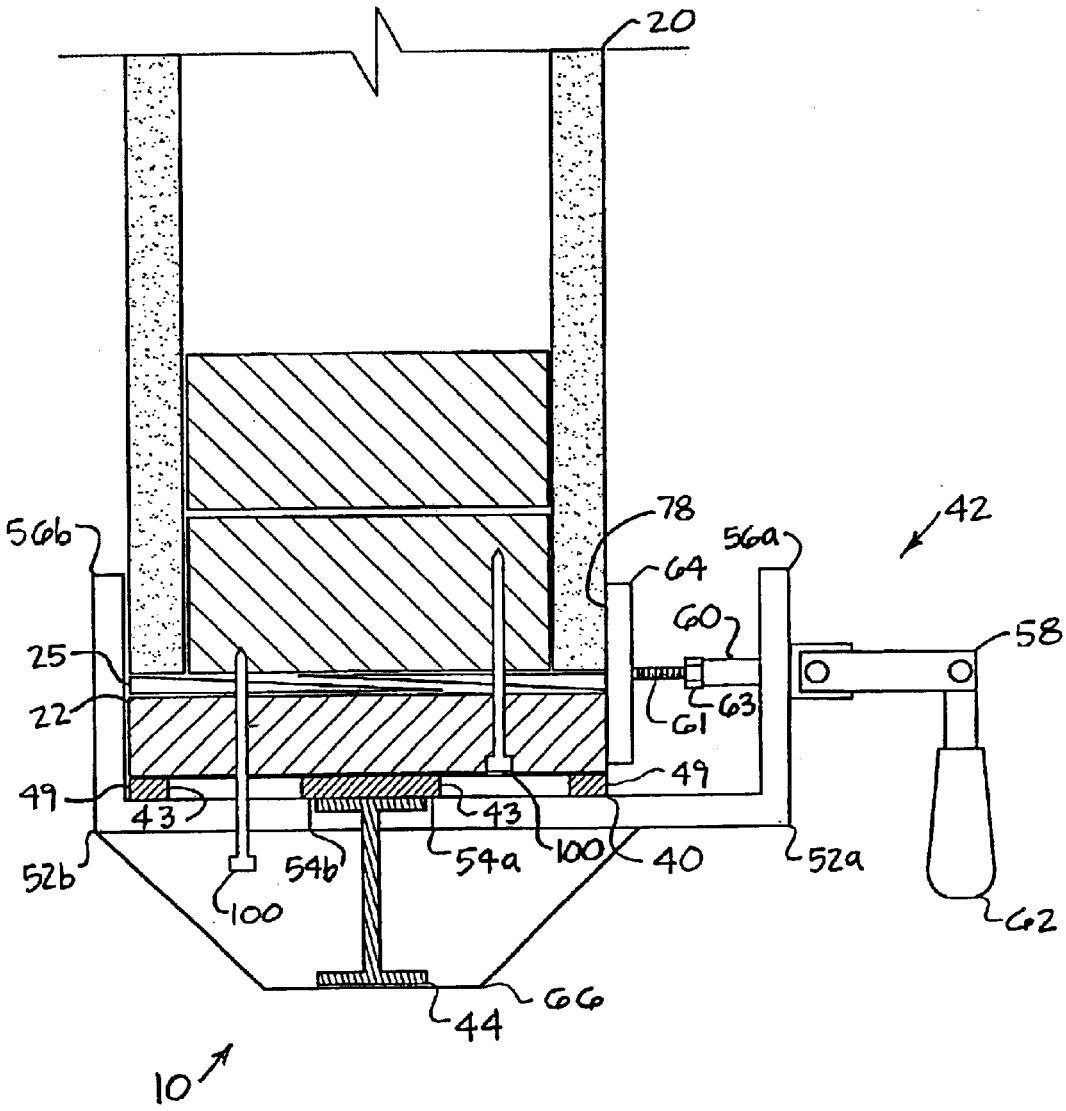
FIG. 2 is a cross-sectional view of the trim installation tool and the wall opening side edge, taking generally along line 2—2 in FIG. 1.
Figure 3:
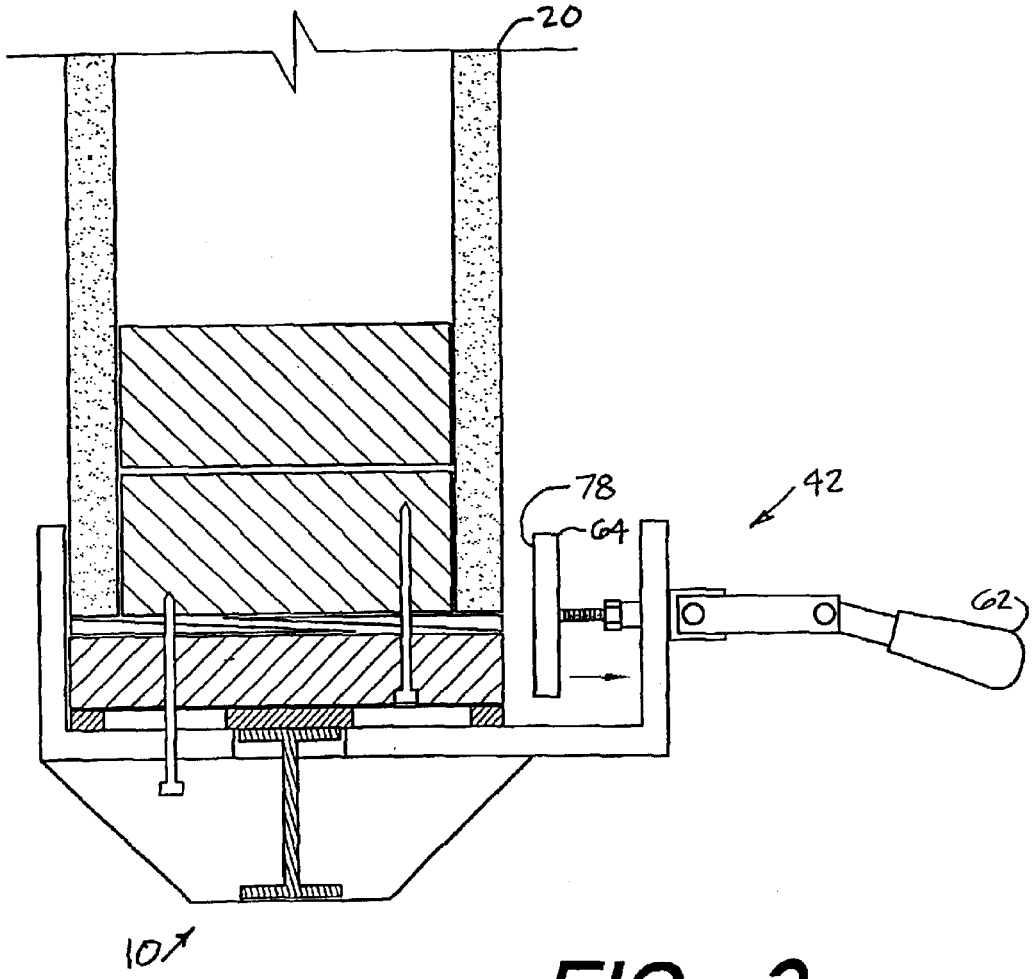
FIG. 3 is a cross-sectional view of the trim installation tool with a clamp assembly thereof in a disengaged position.
Figure 4:
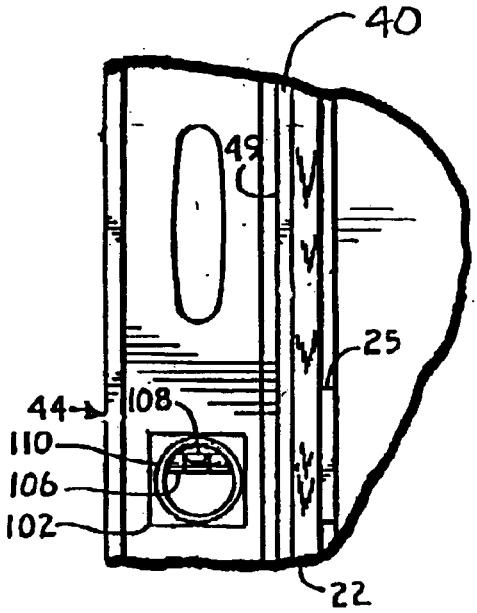
FIG. 4 is a fragmentary, enlarged, side elevational view of the trim installation tool, particularly showing a bubble-type orientation-display assembly thereof.
Figure 5:
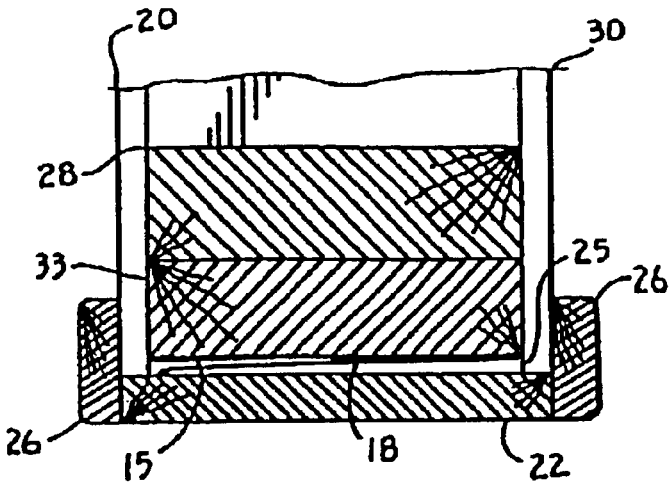
FIG. 5 is a cross-sectional view of a trimmed edge of the door opening.

As required, detailed embodiments and/or aspects of the present invention are disclosed herein; however, it is to be understood that the disclosed embodiments/aspects are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 10 generally designates a trim installation tool. Without limitation on the generality of useful applications of the present invention, the trim installation tool 10 can be utilized for installing a trim system 12 on a wall 20 for finishing or casing a wall opening 18 formed therein with a pair of oppositely-disposed, vertical, jamb edges 15 and a horizontally-disposed head or transom edge 17.

The wall 20 can comprise a conventional wall construction with studs 28 extending vertically in spaced relation (e.g., at 16" or 24" on centers) between wall panels 30. The wall panels 30 can comprise a variety of materials, such as gypsum board, plywood, particle board, etc. A header 31 extends across the top of the wall opening 18 and includes a header plate 32 positioned adjacent to the opening head or transom edge 17 between the wall panels 30. A pair of cripples or trimmers 33 support the header 31; each cripple or trimmer 33 is placed adjacent to a respective wall jamb or side edge 15 between the wall panels 30. The header plate 32 and the trimmers 33 can comprise common framing lumber, such as 2×4's with actual cross-sectional dimensions of about 1½" thick by about 3½" wide.

The wall panels 30 can have thicknesses of, for example, approximately ½ inches each whereby the overall wall thickness would be approximately 4½". However, structural members 28,31,32 and 33 with other dimensions, and wall panels 30 with other thicknesses, can be accommodated with the trim installation tool 10 of the present invention.

The wall 20 described thus far is of generally conventional construction. For aesthetic purposes, the edges 15 and 17 which form the wall opening 18 can be covered by the casing trim system 12 to provide a cased wall opening 18.

The casing trim system 12 can comprise a pair of side or jamb trim pieces 22 and a head or transom trim piece 24, which can be attached to the trimmers 33 and the header plate 32 respectively, e.g., by nailing, with shims 25 installed therebetween for proper positioning. Side and top casing trim pieces 26, 27 are applied to the jamb and head trim pieces 22, 24 and to the trimmers 33 and the header plate 32 through the panels 30. The casing trim pieces 26, 27 thus overlap the panels 30 slightly to conceal the unfinished edges thereof. The tool 10 generally comprises a base 40, a pair of clamp assemblies 42, and a level 44.

II. Base 40

The base 40 includes first and second ends 45, 46 and a rectangular cross-sectional configuration. The base 40 further includes an outer, contact or trim engagement face 37, and an inner face 38. The base 40 has a pair of side edges 49 and a plurality of nailing holes 43.

III. Clamp Assemblies

Each clamp assembly 42 is mounted on the base inner face 38 in proximity to a respective end 45, 46 and includes first and second clamp brackets 52*a,b*. Each bracket 52*a,b* includes a respective base leg 54*a,b* mounted on the base inner face 38 and projecting laterally from a respective base side edge 49. Each bracket 52*a,b* also includes an extension leg 56*a,b* extending outwardly from a respective base leg 54*a,b*. Each first clamp bracket 52*a* includes a toggle clamp 58 with an over-center plunger mechanism 60 with retracted and extended positions. A handle 62 is provided for moving the toggle clamp 58 between its retracted and extended positions. A foot 64 is mounted on the end of the plunger mechanism 60 by a threaded shaft 61 with a set nut 63 in spaced relation from and parallel to the first extension leg 56*a*. A clearance 78 is defined between the foot 64 and the second extension leg 56*b* for receiving the wall 20 adjacent to the wall opening 18. Each clamp assembly 42 also includes a bridge 66 connected to and extending between the base legs 54*a,b* for securing same together in fixed relation corresponding to the thickness of the wall 20.

The toggle clamp 58 can be adjusted to accommodate different wall thicknesses by threadably retracting and extending the foot 64 on the shaft 61. Alternatively, greater variations in wall thickness can be accommodated by providing different clamp brackets 52 with various spacings between their respective extension legs 56*a,b*. For example, wall thicknesses can vary considerably depending upon their construction with studs of different widths. Stud widths varying from 1½ inches to 7½ inches are common. Clamp brackets 52*a,b* for various wall thicknesses can be provided for interchangeably mounting on the base 40 as needed.

Figure 6:
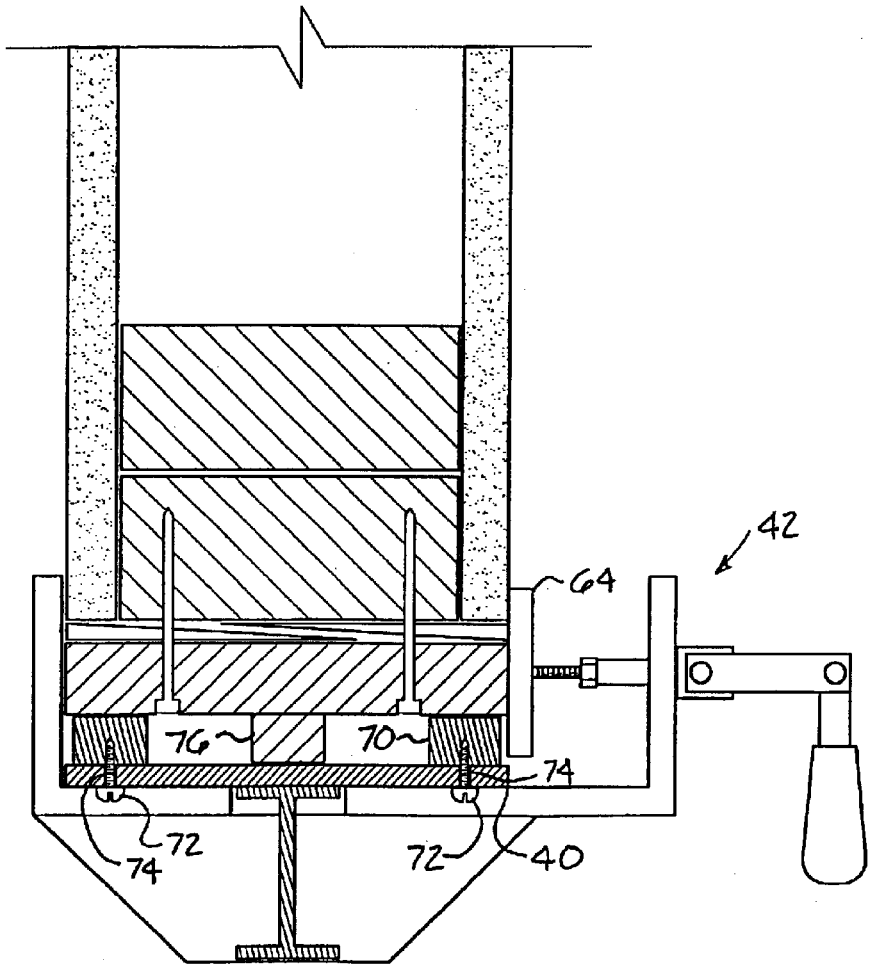
FIG. 6 is a cross-sectional view of a trim installation tool fitted with optional spacers for clearing a door stop trim piece.
Figure 7:
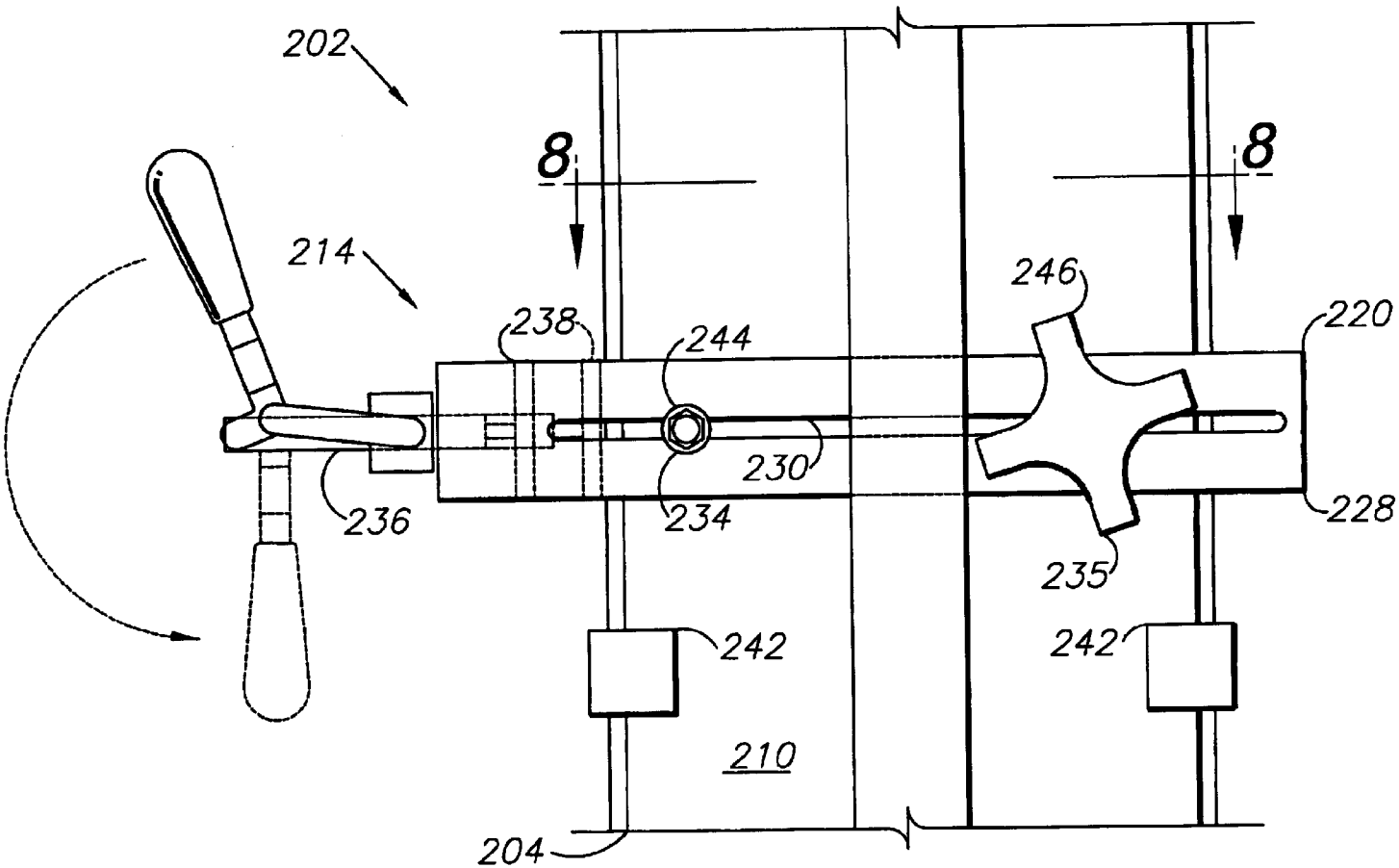
FIG. 7 is a fragmentary, front elevational view of a trim system comprising an alternative embodiment of the present invention, particularly showing a level thereof.
Figure 8:
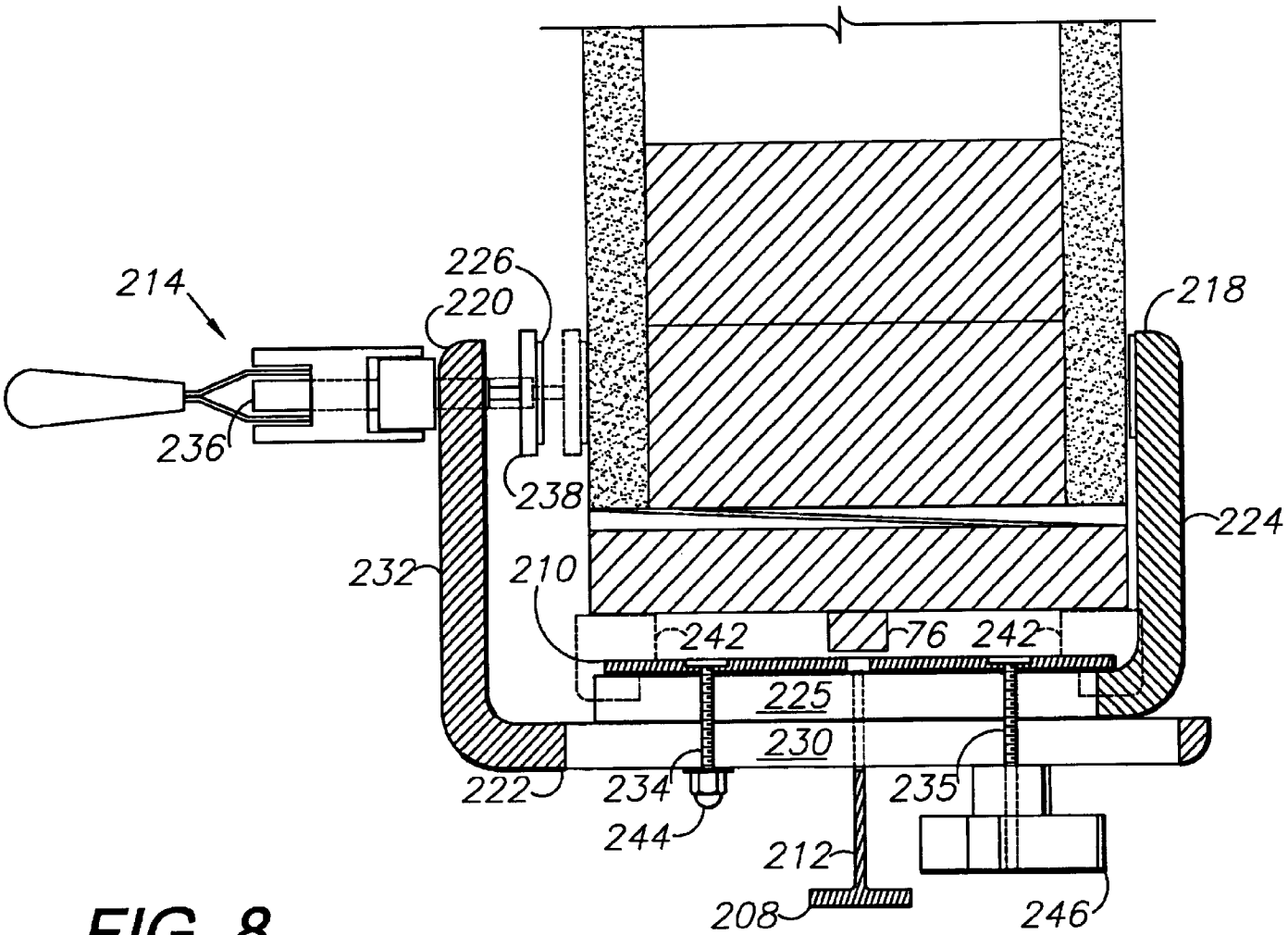
FIG. 8 is a horizontal cross-section thereof, taking generally along line 8—8 in FIG. 7.

FIG. 6 shows an optional configuration of the tool 10 with spacers 70 mounted on the base outer face 37 by screws 72 extending through receivers 74 formed in the base 40 at regular intervals. The spacers 70 space the base 40 inwardly from the trim pieces 22, 24 to clear a door stop trim piece 76. It will be appreciated that the spacers 70 can easily be installed and removed as needed, and different thicknesses of spacers can be provided to provide clearance for different thicknesses of door stop trim pieces 76.

IV. Level 44

The level 44 includes a total of three orientation-display assemblies; two end display assemblies 102 and a middle orientation display assembly 104 mounted in the level 44. Each display assembly 102, 104 includes a liquid-filled tube 106 with a bubble 108, the tube 106 being mounted in an annular rum 110 and extending more or less diametrically thereacross. The rims 110 can be rotatable for reorienting the tubes 106.

The level 44 can comprise a standard, commercially-available level of the type commonly used in construction. The overall length should preferably be under six feet in order to fit within commonly-encountered door openings. Shorter-length levels can be utilized for mounting head/transom trim pieces 24, for trimming window openings, etc.

V. Operation and Trim Installation Method

In operation, the tool 10 can be used for placing a variety of members and holding them in predetermined positions. The level 44 can provide the user with a relatively accurate indication of the orientation of a member clamped by the tool 10. For example, the tubes 106 can be placed in longitudinal alignment with the tool 10 for indicating the horizontal orientation of the tool 10 and a horizontal member (e.g., head or transom trim piece 24) clamped thereby, or can be oriented substantially transversely with respect to the tool 10 for indicating a vertical orientation of the tool 10 and a vertical member (e.g., side or jamb trim piece 22) clamped thereby. The end orientation-display assemblies 102, 104, with their tubes 106 oriented substantially transversely to the tool 10, can be positioned near the top and bottom of the wall opening 18 (FIG. 1) for reference by a worker in proximity to the clamp assemblies 42.

The clamp assembly clearances 78 receive the wall 20 and can be closed by the feet 64. The nailing holes 43 provide openings for nails 100 or other fasteners to be driven through the respective trim pieces 22, 24 and into respective framing members such as the header plate 32 and the trimmers 33. Pneumatic nail guns could be employed for nailing the trim pieces 22, 24 in place through the nailing holes 43.

VI. Alternative Embodiment Door Trim System and Method

FIGS. 7–10 show a trim installation system 202 comprising an alternative embodiment or aspect of the present invention and generally including a level 204 and a trim piece spacer 206. The level 204 can be constructed with a single-piece, unitary extrusion 206 forming a combined base 210 and level flange 212. The base 210 mounts a pair of clamp assemblies 214 positioned in spaced relation and each comprising first (inner) and second (outer) L-shaped brackets 218, 220. The general configuration and operation of the level 204 are similar to those of the trim installation tool 10 described above.

Each first bracket 218 includes a first base leg 222 mounted on the base 210 and a first extension leg 224 extending from a respective base leg 222 and forming a right angle with respect thereto. The first base leg 222 is slotted at 225. The first extension leg 224 mounts a compressible engagement pad 226. Each second bracket 220 includes a second base leg 228, which is slotted at 230, and a second extension leg 232 forming a right angle with respect thereto. The second base legs 228 overlie the first base legs 222, with their respective slots 225, 230 aligned and receiving fasteners 234, 235, which can comprise suitable machine screws, washers and nuts for releasably clamping the base legs 222 and 228 onto the base 210. For example, a locking-type crown nut 244 can be provided for one of the fasteners 234, and a handwheel 246 can be provided for the other fastener 235 whereby loosening and tightening adjustments can be made quickly and manually.

The base legs 222 and 228 are thus adapted to slide with respect to each other and with respect to the base 210, whereby the openings or jaws defined by the clamp assemblies 214 can be adjusted. For example, adjustments in the range of about 4½ inches to about 11¼ inches will accommodate most wall thicknesses commonly encountered in construction. Each second bracket extension leg 232 mounts a plunger assembly 236, which includes a foot 238 mounting a compressible engagement pad 240. Spacer clips 242 are clipped on the edges of the base 210 for spacing same from the jamb of a door and for providing clearance over a door stop 76.

The spacer 206 includes a body 252 with a lower bar 254 having an upwardly-open channel 256 and an upper bar 258 with a longitudinally-extending slot 260, which generally aligns with the channel 256. A set screw assembly 262 is mounted on a lower bar inner end 264 and is slidably received in the upper bar slot 260. A disk-shaped nut 266 of the set screw assembly 262 is adapted for tightening and loosening same by hand whereby the bars 254 and 258 are selectively clamped together or adjustably slidable with respect to each other.

The lower and upper bars 254, 258 include outer ends 268, 274 respectively, each mounting a cross brace 270. Each cross brace 270 includes transversely, slidably adjustable brace spacers 272, which function like the spacer clips 242 described above to provide clearance over the door stop 76.

In operation, the clamp assemblies 214 are adapted for adjustment by sliding the brackets 218, 220 with respect to each other whereby the thickness of a wall can be approximated. In many construction jobs, similar wall thicknesses are encountered repeatedly whereby a number of openings can be trimmed without readjusting the clamp assemblies 214. When different wall thicknesses are encountered, readjustment can be easily accomplished with the clamp assemblies 214.

Figure 9:
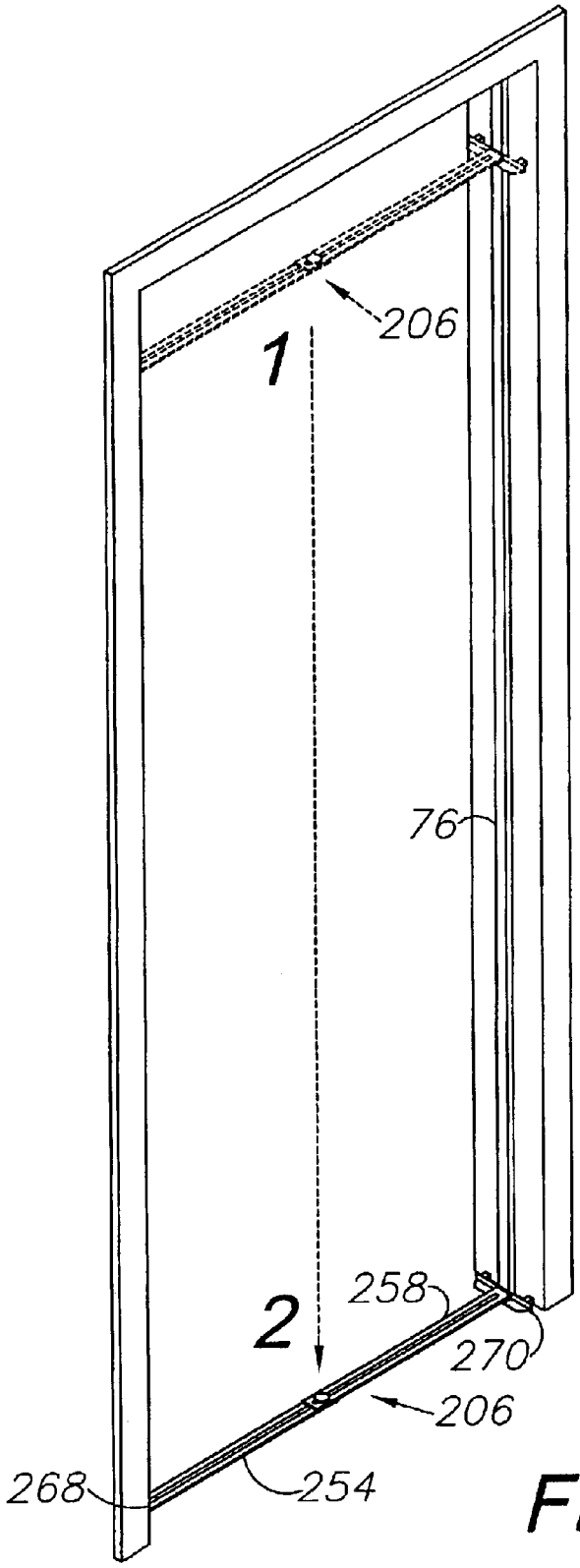
FIG. 9 is an upper, perspective view of a door opening, showing a spacer of the alternative embodiment trim system located therein at top and bottom positions within the opening.
Figure 10:
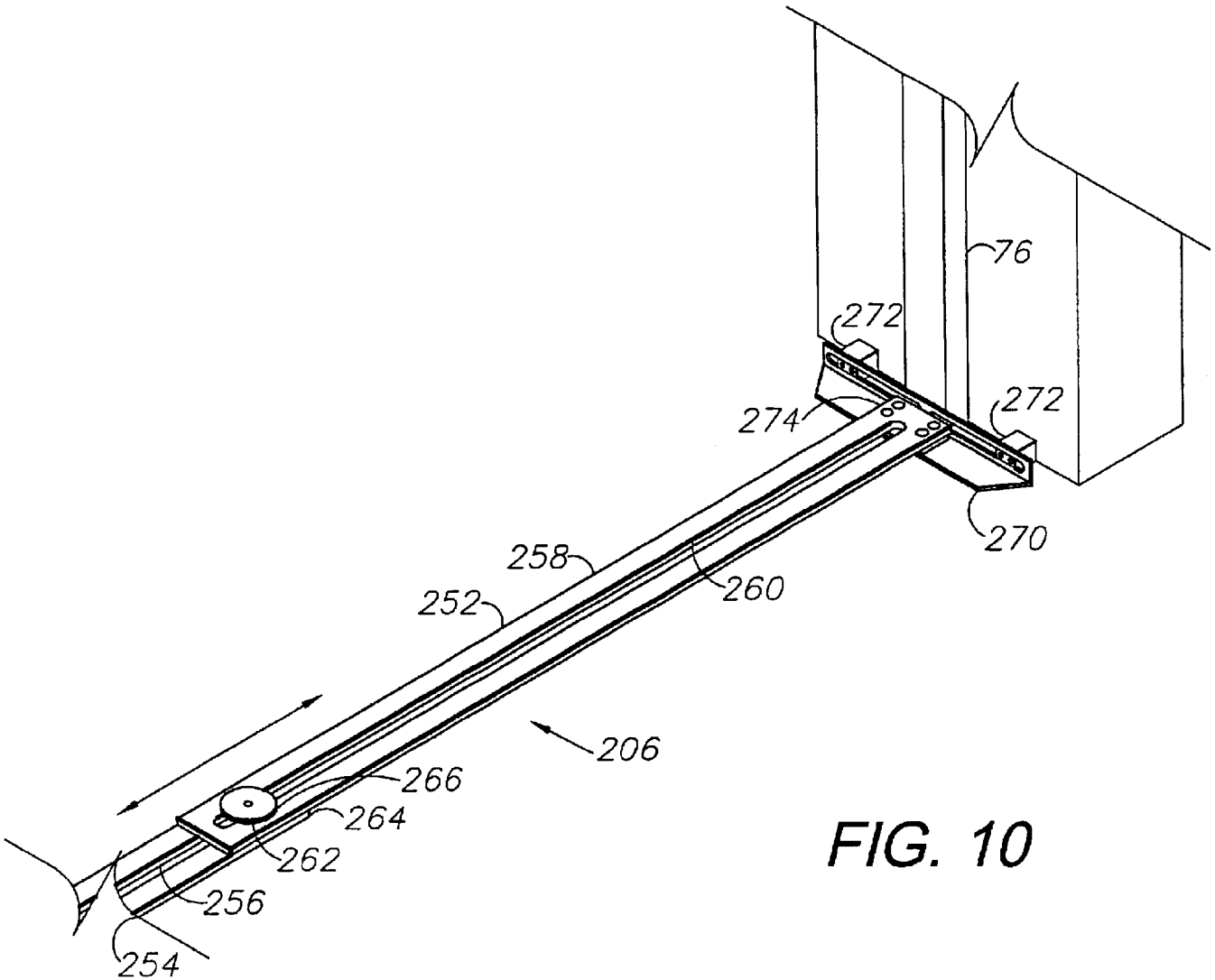
FIG. 10 is an upper, perspective view of the spacer.

The clamp assembly plungers 236 likewise facilitate fine adjustments to accommodate different wall thicknesses. The feet 238 thereof can be threadably adjusted to tighten or loosen the clamp assemblies 214. The level 204 is used in a similar manner to the trim installation tool 10 described above. The spacer 206 is adapted for squaring the trim within an opening by calibrating a constant spacing between parallel trim members, such as the jambs. For example, as shown in FIG. 9, the spacer 206 can be placed at the top of a door frame to gauge the spacing of the jamb trim pieces. The spacer 206 is readily adjustable by loosening and tightening the set screw assembly 262 by manually tightening and loosening the disk-shaped nut 266, permitting the bars 254, 258 to reciprocably slide with respect to each other whereby the cross brace 270 engages the jamb trim pieces on either side of the opening. The spacer 206 can then be repositioned by, for example, placing it at the bottom of the opening as shown in FIG. 9. The trimmed opening can thus be held to relatively precise tolerances, which facilitate proper fit and operation of doors, windows and other finish constructions.

It is to be understood that while certain embodiments and/or aspects of the invention have been shown and described, the invention is not limited thereto and encompasses various other embodiments/aspects.

What is claimed and desired to be secured by Letters Patent is as follows:

1. A system for installing trim in an opening in a wall including opposite wall opening side edges and a wall opening header edge, which system comprises:

a base with opposite ends, opposite first and second side edges, an outer/engagement face, an inner face and first and second lines of spaced openings extending parallel to and spaced inwardly from the first and second side edges respectively;

a pair of clamp assemblies each located in proximity to a respective base end and including:

first and second brackets including first and second base legs respectively connected to said base inner face and projecting laterally from said base first and second edges respectively and first and second extension legs each extending outwardly from a respective base leg and projecting outwardly beyond said base outer face;

each said bracket base leg including a longitudinally-extending slot, said base leg slots of each clamp assembly being at least partially aligned;

each said clamp assembly including first and second mechanical fasteners, one of which includes a manually operable threaded component adapted for tightening and loosening said mechanical fastener by hand and the other of which includes a locking nut adapted for locking in a fixed position;

each said mechanical fastener having a tightened configuration securing said brackets in fixed relation on said base and a loosened configuration permitting adjustably repositioning same;

a clamp assembly clearance located between said first and second extension legs and adapted to receive said wall adjacent to said opening therein;

each said clamp assembly including a toggle clamp mounted on said first extension leg and including an over-center plunger mechanism movable between retracted and extended positions with respect to said first extension leg, said clamp including a handle mounted outside said first extension leg and adapted for moving said plunger mechanism between its retracted and extended positions, each said clamp assembly including a foot threadably adjustably mounted on said plunger mechanism and including a resilient engagement pad adapted for engaging said wall with said plunger mechanism in its extended position and retracted from said wall with said plunger mechanism in its retracted position;

said first and second base legs being mounted in overlying relation on said base and adapted for being adjustably reciprocably extended and retracted with respect to each other and said base whereby said clamp assembly clearance is increased and decreased respectively;

an elongated level flange with first and second ends, said level flange being mounted on said base inner face with its first and second ends located in proximity to said base ends respectively, said level flange including first and second end orientation-display assemblies each located in proximity to a respective level end and a medial orientation-display assembly located intermediate said first and second end orientation-display assembles;

each said orientation-display assembly including a liquid-filled tube with a bubble;

multiple spacer clips each adjustably and removably mounted on said base and adapted for spacing said base from a trim piece; and a trim piece spacer which is not connected to the base including: a body with a lower bar having an upwardly-open, longitudinally-extending channel and an upper bar having a longitudinally-extending slot; a set screw assembly slidably received in said channel and said slot, said set screw assembly having a loosened configuration permitting longitudinal sliding of said bars with respect to each other and a tightened configuration securing said bars together whereby said spacer length is fixed; each said bar having an outer end; a pair of cross braces each mounted on a respective bar outer end; and each said cross brace having a pair of brace spacers transversely adjustably mounted thereon and adapted for spacing said cross brace from a respective trim piece.

* * * * *